US006580022B2

(12) United States Patent
Kang

(10) Patent No.: US 6,580,022 B2
(45) Date of Patent: Jun. 17, 2003

(54) MACHINE HEAD FOR GUITAR

(76) Inventor: Han-Soo Kang, 264-14, Kaebong-Dong, Kuro-Gu, Seoul (KR)

( * ) Notice: Subject to any disclaimer, the term of this patent is extended or adjusted under 35 U.S.C. 154(b) by 0 days.

(21) Appl. No.: 09/933,813

(22) Filed: Aug. 22, 2001

(65) Prior Publication Data

US 2002/0148342 A1 Oct. 17, 2002

(30) Foreign Application Priority Data

Apr. 12, 2001 (KR) ..... 2001-10313 U
Jun. 29, 2001 (KR) ..... 2001-19705 U

(51) Int. Cl.[7] ..... G10D 3/14
(52) U.S. Cl. ..... 84/304; 84/297 R; 84/306
(58) Field of Search ..... 84/304, 297 R, 84/306

(56) References Cited

U.S. PATENT DOCUMENTS 554,057 A * 2/1896 Durkee ..... 84/304
4,748,889 A * 6/1988 Schaller ..... 84/297 R
5,103,708 A * 4/1992 Steinberger ..... 84/304

* cited by examiner

*Primary Examiner*—Shih-Yung Hsieh
(74) *Attorney, Agent, or Firm*—Jacobson Holman PLLC

(57) ABSTRACT

Disclosed is a machine head for a guitar. The machine head comprises a clamping section which has a tuning peg and a clamping cap. The tuning peg is defined with a first insertion hole, which extends in a transverse direction and through which a guitar string is inserted, and a second insertion hole, which extends in a longitudinal direction and is communicated with the first insertion hole. The tuning peg is formed on a circumferential outer surface thereof with an externally threaded portion. The clamping cap is formed on a circumferential inner surface thereof with an internally threaded portion and has integrated therewith a clamping member. The clamping member is inserted through the second insertion hole and has a lower end of a semi-spherical configuration.

6 Claims, 9 Drawing Sheets

MACHINE HEAD FOR GUITAR

BACKGROUND OF THE INVENTION

1. Field of the Invention

The present invention relates to a machine head for a guitar which is used for adjusting tension of a guitar string and thereby tuning the guitar string, and more particularly, the present invention relates to a machine head for a guitar which allows a guitar string to be reliably clamped to a tuning peg while being effectively prevented from snapping.

2. Description of the Related Art

Generally, a machine head for a guitar, which is mounted to a head of the guitar, is used for clamping an end of a guitar string to the head of the guitar, adjusting tension of the guitar string by winding or unwinding the guitar string on or from a tuning peg through rotation of a tuning handle, and thereby tuning the guitar string.

In the conventional machine head for a guitar, by rotating a tuning handle secured to an end of a worm shaft which extends through a machine head body, a worm wheel which is meshed with a worm of the worm shaft inside the body is rotated, and thereby, a tuning peg is also rotated. By this, a guitar string which is inserted through a guitar string insertion hole which is defined in the tuning peg, is wound or unwound on or from the tuning peg, whereby the guitar string is allowed to be tuned.

However, the conventional machine head for a guitar suffers from a problem in that it is necessary for a person to hold the guitar string around a spool portion of the tuning peg using the fingers until the guitar string is clamped to the tuning peg through the rotation of the tuning handle, whereby inconvenience is caused to the person while holding the guitar string around the spool portion of the tuning peg. Also, because the guitar string is clamped by being wound through several turns on the tuning peg, the guitar string is likely to be loosened, and it is necessary to frequently perform a guitar string tuning work.

To cope with these problems, the present applicant disclosed a machine head for guitars as described in U.S. Pat. No. 6,078,001, and a guitar string tuning device as described in U.S. Pat. No. 6,172,287. Hereinafter, the guitar string tuning device which is disclosed in U.S. Pat. No. 6,172,287 will be described by reference.

FIG. 6 is an exploded perspective view illustrating a conventional guitar string tuning device. The guitar string tuning device 1 includes a body 100, a manipulating lever, a tuning peg 120 and a clamping section 150. A guitar string W is wound on and unwound from the tuning peg 120 to be tuned thereby. The tuning peg 120 has a slit 122 which is defined at an upper end thereof and a worm wheel which is formed at a lower end thereof. The body 100 accommodates the tuning peg 120 therein in a manner such that the tuning peg 120 is maintained in an upright posture. The manipulating lever has a worm which is formed at one end thereof in a manner such that the worm enters into the body 100 to be meshed with the worm wheel of the tuning peg 120 accommodated in the body 100 and a tuning handle 110 which is formed at the other end thereof. The clamping section 150 functions to clamp the guitar string W to the tuning peg 120 which is rotated by manipulating the tuning handle 110. The clamping section 150 includes a clamping cap 140 which has arranged therein a clamping member 132. The clamping member 132 is fastened to the clamping cap 140 by means of a suitable fastener 130 such as a screw, a pin and the like. The clamping member 132 has a predetermined width extending in a lengthwise direction of the guitar string W which is inserted through the slit 122 of the tuning peg 120. An externally threaded portion is formed on a circumferential outer surface of the tuning peg 120, and an internally threaded portion is formed on a circumferential inner surface of the clamping cap 140. As the internally threaded portion of the tuning peg 120 is screwed into the externally threaded portion of the clamping cap 140, the clamping member 132 is moved downward and squeezes the guitar string W against a bottom surface of the slit 122 defined in the tuning peg 120.

As a consequence, it is possible to conveniently clamp the guitar string W with uniform clamping force exerted over a predetermined length of the guitar string W. However, the conventional guitar string tuning device still suffers from a defect in that, since both ends of the bottom surface defining the slit 122 and both ends of a lower end surface of the clamping member 132 are respectively bent at right angles, the likelihood of the guitar string W to frequently snap is increased upon continued use.

Moreover, because the clamping member 132 is fastened to the clamping cap 140 by means of the fastener such as a screw, a pin and the like, bothersomeness is caused due to a complex assembling procedure.

Further, due to the fact that the clamping cap 140 and the tuning peg 120 are threadedly coupled with each other, the clamping cap 140 is apt to be lost.

SUMMARY OF THE INVENTION

Accordingly, the present invention has been made in an effort to solve the problems occurring in the related art, and an object of the present invention is to provide a machine head for a guitar which allows a guitar string to be reliably clamped to a tuning peg while being effectively prevented from snapping.

Another object of the present invention is to provide a machine head for a guitar which can be easily mounted to a head of the guitar.

Still another object of the present invention is to provide a machine head for a guitar in which a clamping cap is prevented from being lost.

Yet still another object of the present invention is to provide a machine head for a guitar in which a clamping cap and a clamping member are conveniently assembled with each other.

In order to achieve the above objects, according to one aspect of the present invention, there is provided a machine head for a guitar, comprising: a clamping section having a tuning peg and a clamping cap; the tuning peg being defined with a first insertion hole, which extends in a transverse direction and through which a guitar string is inserted, and a second insertion hole, which extends in a longitudinal direction and is communicated with the first insertion hole, and being formed on a circumferential outer surface thereof with an externally threaded portion; and the clamping cap being formed on a circumferential inner surface thereof with an internally threaded portion and having integrated therewith a clamping member which is inserted through the second insertion hole and has a lower end of a semi-spherical configuration.

According to another aspect of the present invention, the second insertion hole extends through the first insertion hole in a manner such that a lower end of the second insertion hole has a level which is lower than that of the first insertion hole.

According to another aspect of the present invention, a diameter of the clamping cap is no greater than that of the tuning peg.

According to still another aspect of the present invention, the machine head further comprises a release preventing section which includes an extended portion, a release preventing ring and a receiving groove, the extended portion being formed on an upper end of the tuning peg, the release preventing ring being fitted around the extended portion and the receiving groove in which the release preventing ring is received being defined on the circumferential inner surface of the clamping cap at an upper end of the internally threaded portion.

According to yet still another aspect of the present invention, the machine head further comprises a coupling section which includes a circumferential groove, a fastening ring and a coupling groove, the circumferential groove being defined adjacent to an upper end of the clamping member, the fastening ring being fitted into the circumferential groove and the coupling groove in which the fastening ring is engaged being defined on the circumferential inner surface and adjacent to an upper end of the clamping cap.

BRIEF DESCRIPTION OF THE DRAWINGS

The above objects, and other features and advantages of the present invention will become more apparent after a reading of the following detailed description when taken in conjunction with the drawings, in which:

FIGS. 2*a* and 2*b* are partial enlarged cross-sectional views of the assembled machine head for a guitar, wherein FIG. 2*a* illustrates a state in which a guitar string is not clamped and FIG. 2*b* illustrates a state in which a guitar string is clamped;

FIGS. 4*a* and 4*b* are partial enlarged cross-sectional views of a machine head for a guitar in accordance with a third embodiment of the present invention, wherein FIG. 4*a* illustrates a state in which a clamping cap and a tuning peg are separated from each other and FIG. 4*b* illustrates a state in which the clamping cap and the tuning peg are assembled with each other;

FIGS. 5*a* and 5*b* are partial enlarged cross-sectional views of a machine head for a guitar in accordance with a fourth embodiment of the present invention, wherein FIG. 5*a* illustrates a state in which a clamping cap and a clamping member are separated from each other and FIG. 5*b* illustrates a state in which the clamping cap and the clamping member are assembled with each other.

DETAILED DESCRIPTION OF PREFERRED EMBODIMENTS

Figure 1:
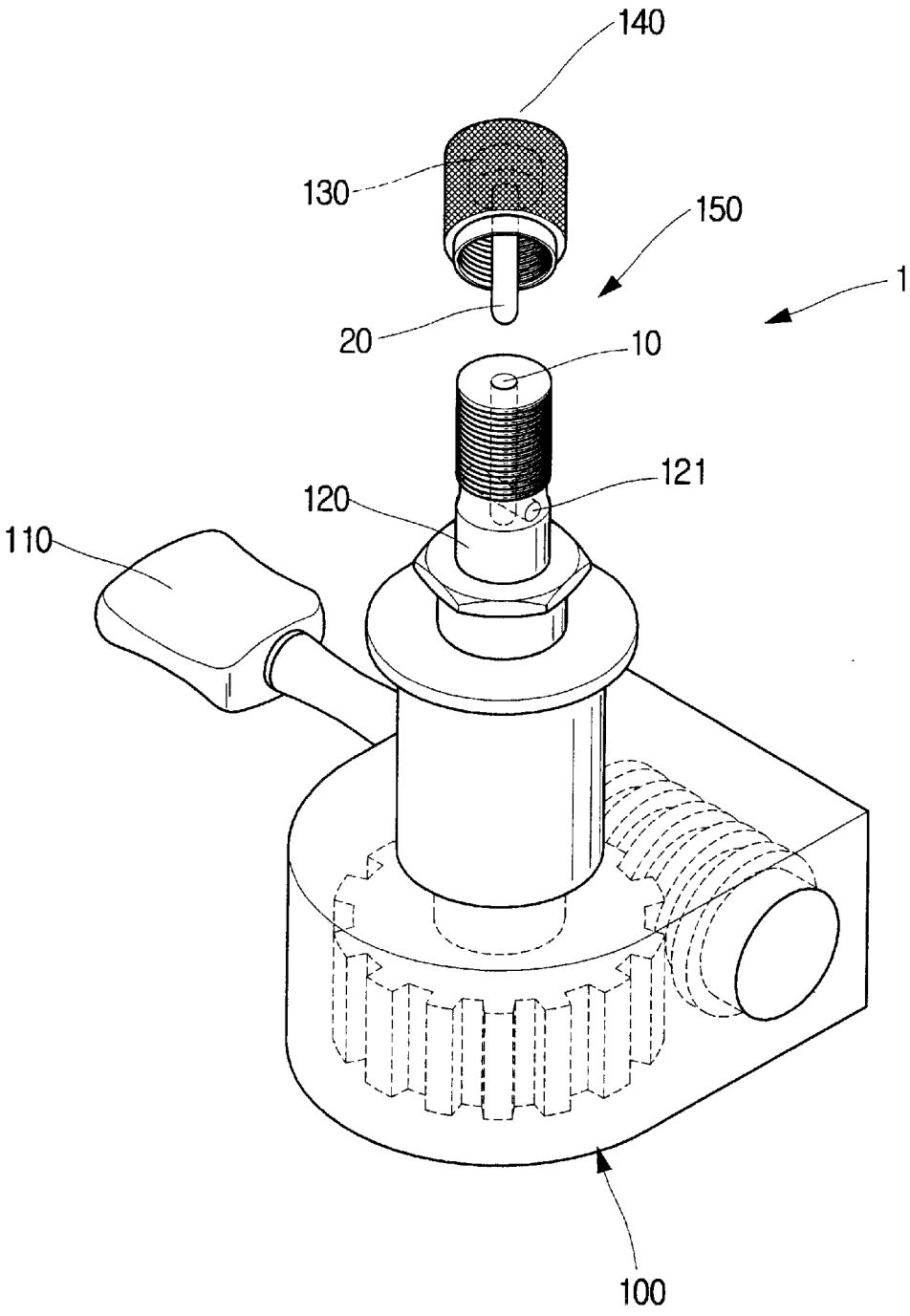
FIG. 1 is an exploded perspective view illustrating a machine head for a guitar in accordance with a first embodiment of the present invention.

Reference will now be made in greater detail to a preferred embodiment of the invention, an example of which is illustrated in the accompanying drawings. Wherever possible, the same reference numerals will be used throughout the drawings and the description to refer to the same or like parts.

FIG. 1 is an exploded perspective view illustrating a machine head for a guitar in accordance with a first embodiment of the present invention. A guitar string W is wound on and unwound from a tuning peg 120 to be tuned thereby. The tuning peg 120 has a worm wheel which is formed at a lower end thereof. A machine head body 100 accommodates the tuning peg 120 therein in a manner such that the tuning peg 120 is maintained in an upright posture. A manipulating lever has a worm which is formed at one end thereof in a manner such that the worm enters into the body 100 to be meshed with the worm wheel of the tuning peg 120 accommodated in the body 100 and a tuning handle 110 which is formed at the other end thereof. The machine head 1 according to the present invention includes a clamping section 150. The clamping section 150 functions to clamp the guitar string W to the tuning peg 120 which is rotated by manipulating the tuning handle 110. The clamping section 150 has the tuning peg 120 and a clamping cap 140. The tuning peg 120 is defined with a first insertion hole 121, which extends in a transverse direction and through which the guitar string W is inserted, and a second insertion hole 10, which extends in a longitudinal direction and is communicated with the first insertion hole 121. The tuning peg 120 is formed on a circumferential outer surface thereof with an externally threaded portion. The clamping cap 140 is formed on a circumferential inner surface thereof with an internally threaded portion and has integrated therewith a clamping member 130. The clamping member 130 is inserted through the second insertion hole 10 and has a lower end of a semi-spherical configuration. The clamping member 130 can be fastened to the clamping cap 140 by a suitable fastener such as a screw, a pin and the like.

In a preferred embodiment of the present invention, the second insertion hole 10 extends through the first insertion hole 121 in a manner such that a lower end of the second insertion hole 10 has a level which is lower than that of the first insertion hole 121, to provide greater fastening strength.

Figure 2A:
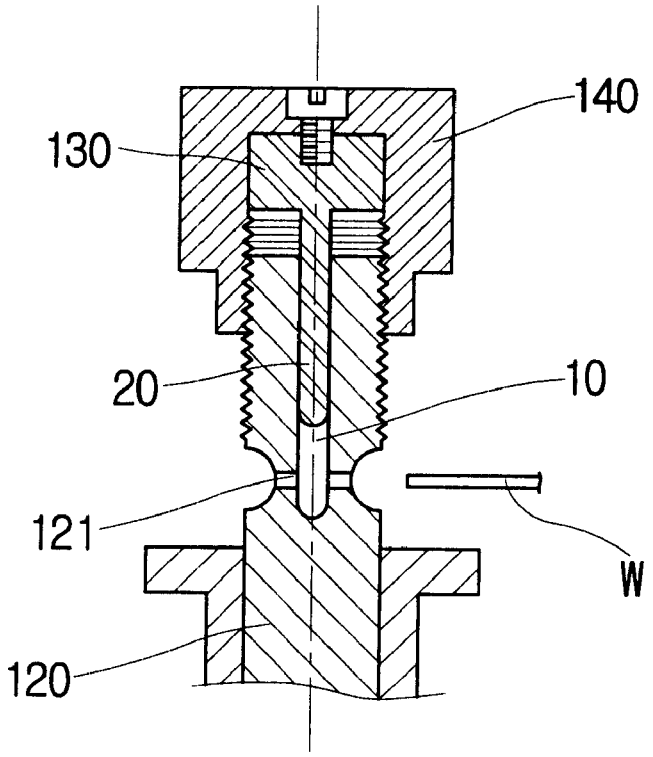
Figure 2B:
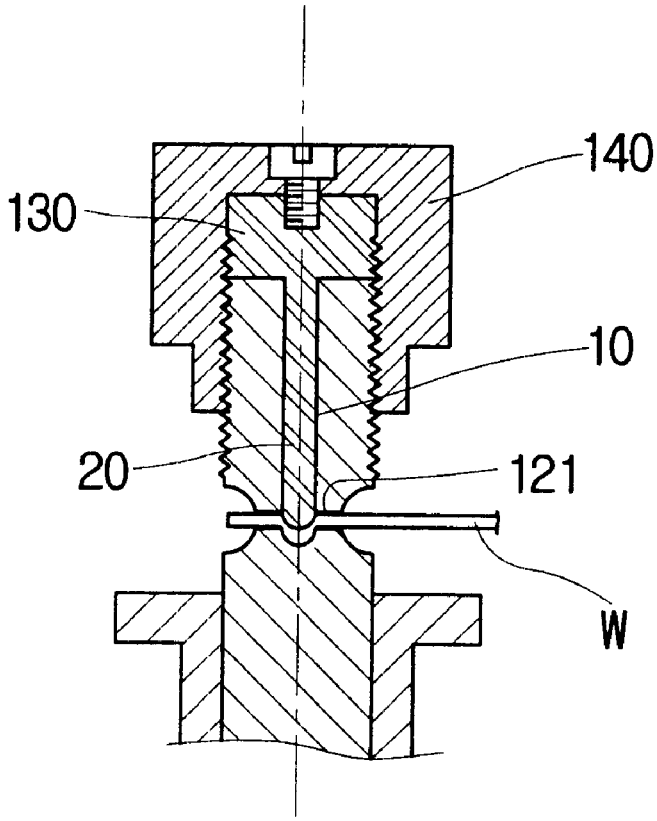

FIGS. 2*a* and 2*b* are partial enlarged cross-sectional views of the assembled machine head for a guitar, wherein FIG. 2*a* illustrates a state in which a guitar string is not clamped.

As can be readily seen from FIG. 2*a,* by the above-described construction, upon clamping the guitar string W, one end of the guitar string W is inserted through the first insertion hole 121 which is defined in the tuning peg 120 to extend in the transverse direction. The clamping cap 140 is threadedly coupled to the tuning peg 120 before inserting the guitar string W through the first insertion hole 121. In this case, while a rod 20 of the clamping member 130 which is fastened to the clamping cap 140 is inserted into the second insertion hole 10, a lower end thereof is maintained in a state wherein it does not reach an upper end of the first insertion hole 121.

FIG. 2*b* illustrates a state in which a guitar string is clamped.

As can be readily seen from FIG. 2*b,* after the guitar string W is inserted through the first insertion hole 121 from a state shown in FIG. 2*a,* if the clamping cap 140 is threadedly rotated and lowered, the rod 20 of the clamping member 130 is also integrally lowered along the second insertion hole 10 to squeeze and thereby clamp the guitar string W inserted through the first insertion hole 121, to the tuning peg 120.

When the guitar string W is squeezed and clamped as described above, because the second insertion hole 10 extends through the first insertion hole 121 in a manner such that the lower end of the second insertion hole 10 has a level which is lower than that of the first insertion hole 121, the guitar string W is clamped while being curved by the lower end of the rod 20 having the semi-spherical configuration.

By this, the guitar string W can be reliably clamped while being prevented from being loosened. That is to say, due to the fact that the lower end of the rod 20 has the semi-spherical configuration, the guitar string W is curved at a place where the first and second insertion holes are crossed with each other, in such a way as to define an arc-shaped contour, whereby it is possible to prevent the guitar string W from snapping when it is squeezed by the rod 20 and clamped to the tuning peg 120.

Thus, the guitar string W can be reliably clamped to the tuning peg 120 in a convenient manner and effectively prevented from snapping even upon use for extended periods of time.

Figure 3:
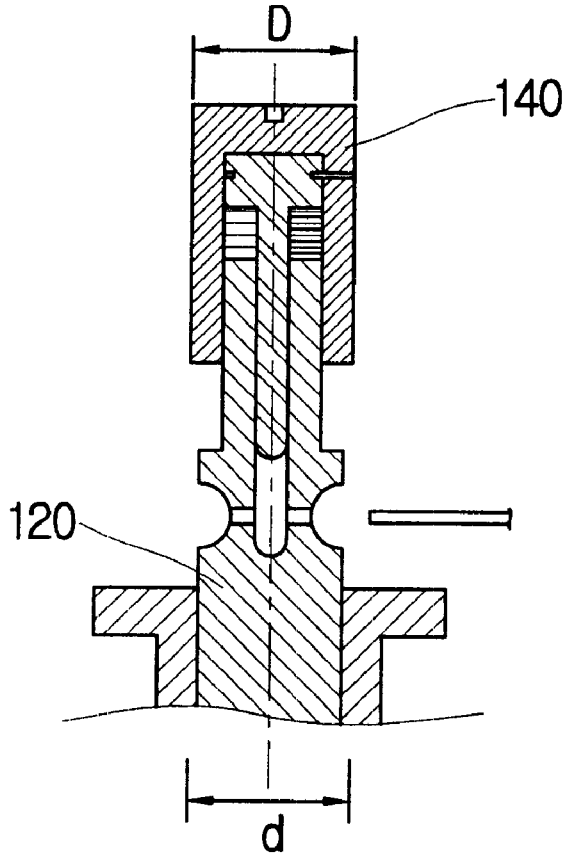
FIG. 3 is a partial enlarged cross-sectional view illustrating a machine head for a guitar in accordance with a second embodiment of the present invention.

FIG. 3 is a partial enlarged cross-sectional view illustrating a machine head for a guitar in accordance with a second embodiment of the present invention.

While it is illustrated in FIGS. 2*a* and 2*b* that the clamping cap 140 has a diameter which is larger than that of the tuning peg 120, in this case, when mounting the machine head to a head of the guitar, bothersomeness is caused in that the clamping cap 140 should be disassembled from the tuning peg 120.

To solve this problem, in this second embodiment of the present invention, the clamping cap 140 is formed in a manner such that it has a diameter D which is equal to or less than a diameter d of the tuning peg 120, whereby the machine head can be easily mounted to the head of the guitar without the need of disassembling the clamping cap 140 from the tuning peg 120.

Consequently, since the machine head can be easily mounted to the head of the guitar, assemblability is improved.

Figure 4A:
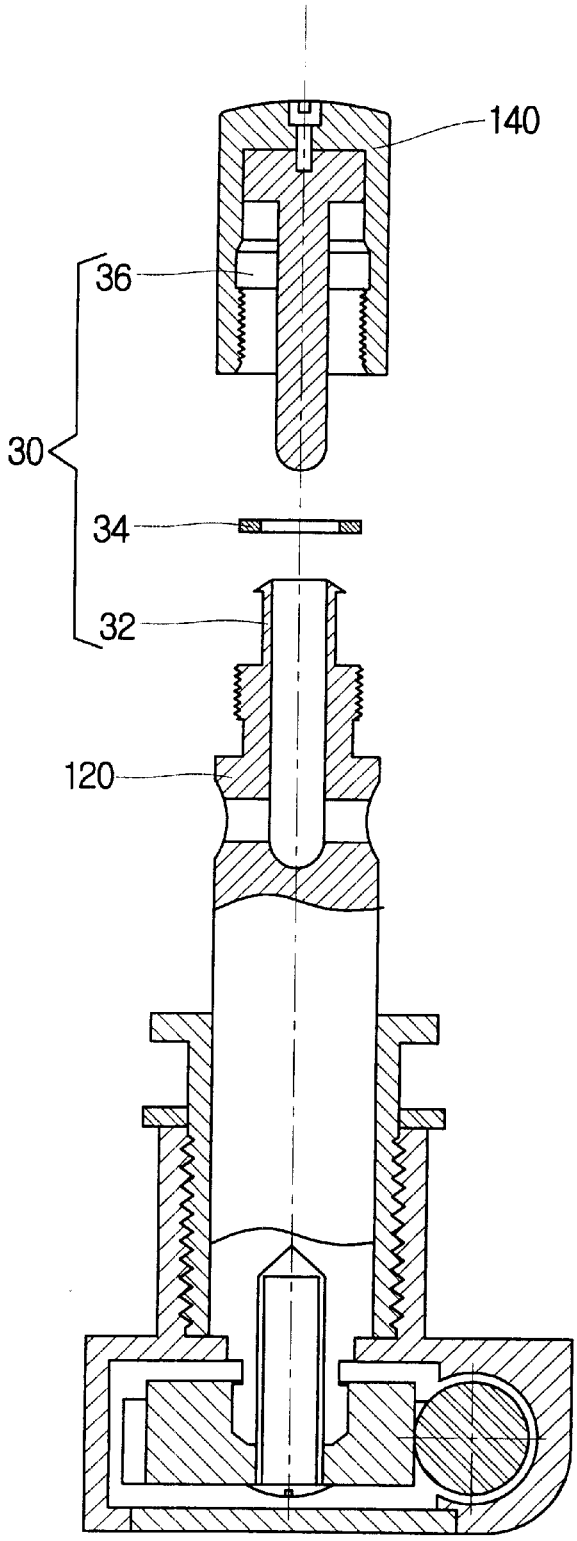
Figure 4B:
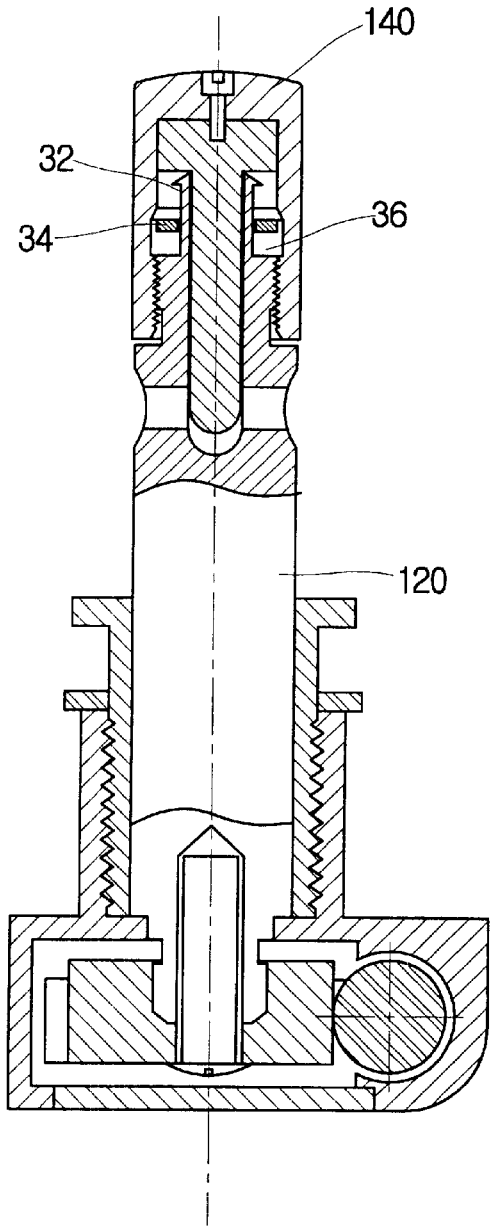

FIGS. 4*a* and 4*b* are partial enlarged cross-sectional views of a machine head for a guitar in accordance with a third embodiment of the present invention, wherein FIG. 4*a* illustrates a state in which a clamping cap and a tuning peg are separated from each other.

In the above-described first and second embodiments, because the clamping cap is threadedly coupled to the tuning peg, the clamping cap can be separated from the tuning peg. Thus, the probability of the clamping cap to be lost is increased.

To solve this problem, in this third embodiment of the present invention, the machine head has a release preventing section 30 which includes an extended portion 32, a release preventing ring 34 and a receiving groove 36. The extended portion 32 is formed on an upper end of the tuning peg 120. The release preventing ring 34 is interference-fitted around the extended portion 32. The receiving groove 36 in which the release preventing ring 34 is received is defined on the circumferential inner surface of the clamping cap 140 at an upper end of the internally threaded portion.

FIG. 4*b* illustrates a state in which the clamping cap and the tuning peg are assembled with each other.

As can be readily seen from FIG. 4*b,* after the release preventing ring 34 is interference-fitted around the extended portion 32 of the tuning peg 120 from a state shown in FIG. 4*a,* the release preventing ring 34 is received in the receiving groove 36 of the clamping cap 140 in such a way as to prevent the clamping cap 140 from being released from the tuning peg 120.

By this construction, although the clamping cap 140 is threadedly coupled to the tuning peg 120 to clamp the guitar string W, the clamping cap 140 is prevented from being completely released from the tuning peg 120. In other words, due to the fact that the release preventing ring 34 interference-fitted around the extended portion 32 is received in the receiving groove 36 of the clamping cap 140, when the clamping cap 140 is threadedly rotated, the release preventing ring 34 is moved upward and downward in the receiving groove 36. In this way, the release preventing ring 34 effectively prevents the clamping cap 140 from being completely released from the tuning peg 120.

Hence, the probability of the clamping cap 140 to be lost due to release from the tuning peg 120 is minimized.

Figure 5A:
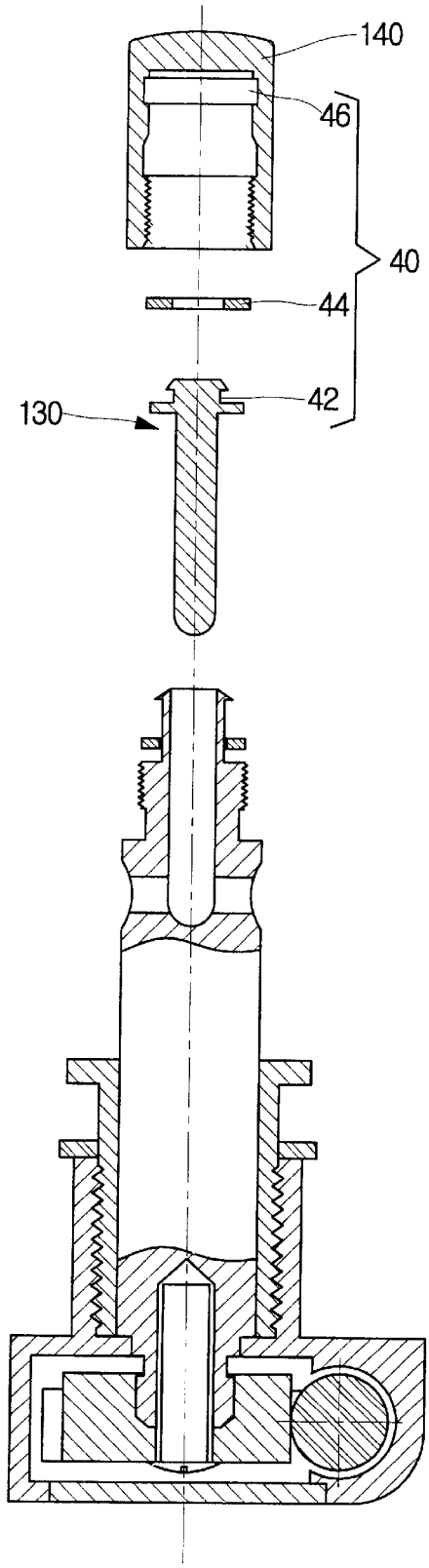
Figure 5B:
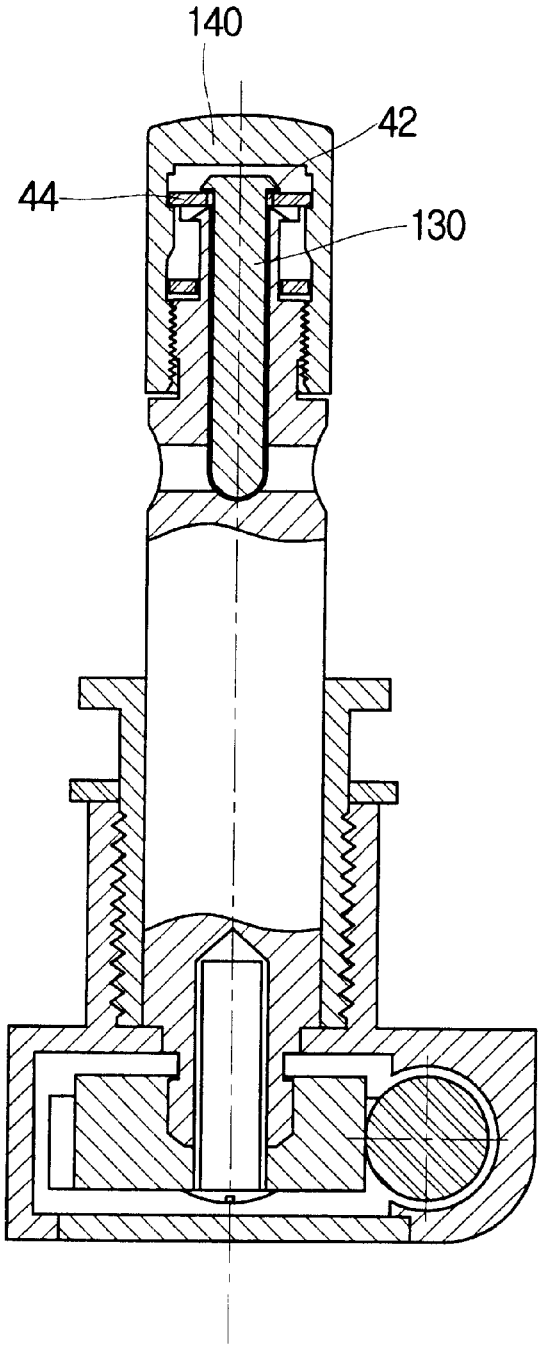
Figure 6:
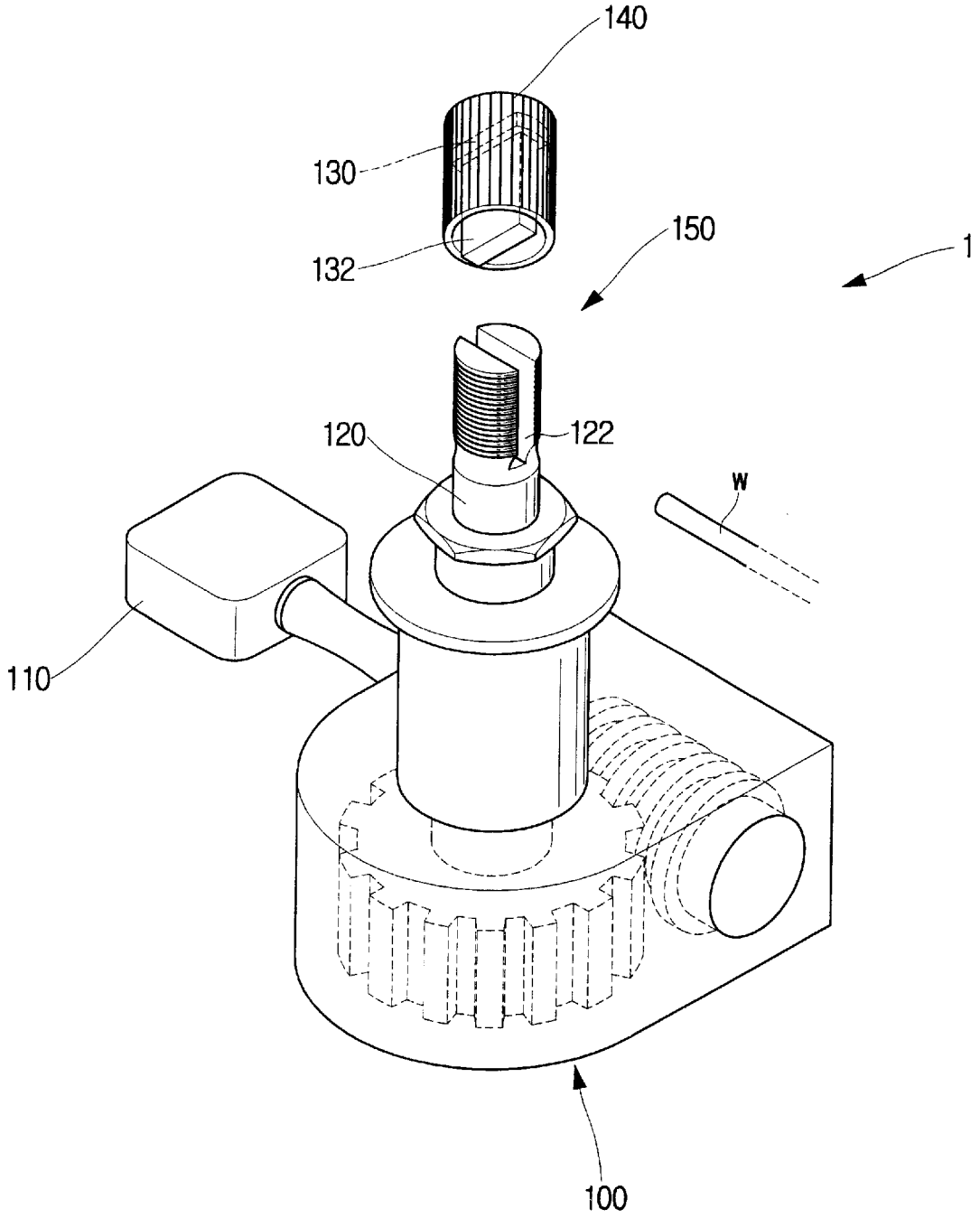
FIG.6 Prior Art
FIG. 6 is an exploded perspective view illustrating a conventional guitar string tuning device.

FIGS. 5*a* and 5*b* are partial enlarged cross-sectional views of a machine head for a guitar in accordance with a fourth embodiment of the present invention, wherein FIG. 5*a* illustrates a state in which a clamping cap and a clamping member are separated from each other.

In the above-described first through third embodiments, because the clamping member is fastened to the clamping cap by means of a fastener such as a screw, a pin and the like, bothersomeness is caused due to a complex assembling procedure and machinability of the machine head is deteriorated.

To solve this problem, in this fourth embodiment of the present invention, the machine head has a coupling section 40 which includes a circumferential groove 42, a fastening ring 44 and a coupling groove 46. The circumferential groove 42 is defined adjacent to an upper end of the clamping member 130. The fastening ring 44 is interference-fitted into the circumferential groove 42. The coupling groove 46 in which the fastening ring 44 is engaged is defined on the circumferential inner surface and adjacent to an upper end of the clamping cap 140.

FIG. 5*b* illustrates a state in which the clamping cap and the clamping member are assembled with each other.

As can be readily seen from FIG. 5*b,* after the fastening ring 44 is interference-fitted into the circumferential groove 42 of the clamping member 130 from a state shown in FIG. 5*a,* the fastening ring 44 is inserted or engaged into the coupling groove 46.

Thus, the problem which is induced due to the fact that the clamping member is fastened to the clamping cap by means of a screw, a pin or the like, can be solved. Namely, machinability of the parts is improved by virtue of interference fit between the clamping member and the clamping cap, whereby workability can also be enhanced.

As a result, the machine head for a guitar according to the present invention provides advantages in that a guitar string can be reliably clamped to a tuning peg in a rapid and convenient manner while being effectively prevented from snapping.

Also, the machine head can be easily mounted to a head of the guitar without the need of disassembling a clamping cap from a tuning peg.

Moreover, bothersomeness which may be caused when the clamping cap is separated from the tuning peg upon clamping the guitar string is avoided, and the clamping cap is prevented from being lost.

Furthermore, since the clamping cap and a clamping member are conveniently interference-fitted with each other upon clamping the guitar string, a working efficiency can be improved.

In the drawings and specification, there have been disclosed typical preferred embodiments of the invention and, although specific terms are employed, they are used in a generic and descriptive sense only and not for purposes of limitation, the scope of the invention being set forth in the following claims.

What is claimed is:

1. A machine head for a guitar, comprising:

a clamping section having a tuning peg and a clamping cap;

the tuning peg being defined with a first insertion hole, which extends in a transverse direction and through which a guitar string is inserted, and a second insertion hole, which extends in a longitudinal direction and is communicated with the first insertion hole, and being formed on a circumferential outer surface thereof with an externally threaded portion;

the clamping cap being formed on a circumferential inner surface thereof with an internally threaded portion and having integrated therewith a clamping member which is inserted through the second insertion hole and has a lower end of a semi-spherical configuration; and a release preventing section which includes an extended portion, a release preventing ring and a receiving groove, the extended portion being formed on an upper end of the tuning peg, the release preventing ring being fitted around the extended portion and the receiving groove in which the release preventing ring is received being defined on the circumferential inner surface of the clamping cap at an upper end of the internally threaded portion.

2. The machine head as claimed in claim 1, wherein the second insertion hole extends through the first insertion hole in a manner such that a lower end of the second insertion hole has a level which is lower than that of the first insertion hole.

3. The machine head as claimed in claim 1, wherein a diameter of the clamping cap is no greater than that of the tuning peg.

4. A machine head for a guitar, comprising:

a clamping section having a tuning peg and a clamping cap;

the tuning peg being defined with a first insertion hole, which extends in a transverse direction and through which a guitar string is inserted, and a second insertion hole, which extends in a longitudinal direction and is communicated with the first insertion hole, and being formed on a circumferential outer surface thereof with an externally threaded portion;

the clamping cap being formed on a circumferential inner surface thereof with an internally threaded portion and having integrated therewith a clamping member which is inserted through the second insertion hole and has a lower end of a semi-spherical configuration; and a coupling section which includes a circumferential groove, a fastening ring and a coupling groove, the circumferential groove being defined adjacent to an upper end of the clamping member, the fastening ring being fitted into the circumferential groove and the coupling groove in which the fastening ring is engaged being defined on the circumferential inner surface and adjacent to an upper end of the clamping cap.

5. The machine head as claimed in claim 4, wherein the second insertion hole extends through the first insertion hole in a manner such that a lower end of the second insertion hole has a level which is lower than that of the first insertion hole.

6. The machine head as claimed in claim 4, wherein a diameter of the clamping cap is no greater than that of the tuning peg.

* * * * *